United States Patent [19]

Czorniak

[11] 4,068,425

[45] Jan. 17, 1978

[54] MODULAR MAUSOLEUM

[75] Inventor: Edward S. Czorniak, Chicago, Ill.

[73] Assignee: Permacrete Products Corporation, Columbus, Ohio

[21] Appl. No.: 784,814

[22] Filed: Apr. 5, 1977

[51] Int. Cl.[2] ..... E04H 1/04; E04B 1/343

[52] U.S. Cl. ..... 52/136; 52/236.8

[58] Field of Search ..... 52/79.9, 79.11, 79.3, 52/79.13, 134, 136, 137, 236.3, 236.6, 236.7, 236.8, 236.9, 227; 61/56

[56] References Cited

U.S. PATENT DOCUMENTS

| | | | |
|---|---|---|---|
| 3,238,732 | 3/1966 | Aas-Jakobsen | 61/56 |
| 3,495,371 | 2/1970 | Mitchell | 52/236.7 |
| 3,593,532 | 7/1971 | Grazel | 61/56 |
| 3,710,527 | 1/1973 | Farebrother | 52/236.7 |
| 3,744,200 | 7/1973 | Rice | 52/236.9 |
| 3,812,637 | 5/1974 | Yang et al. | 52/236.8 |
| 3,897,663 | 8/1975 | Gaul | 52/236.9 |

*Primary Examiner*—J. Karl Bell
*Attorney, Agent, or Firm*—D. Paul Weaver

[57] ABSTRACT

A multiple crypt or vault burial mausoleum features precast concrete modules each having a horizontal shelf and depending vertical walls to define plural crypts when in stacked relationship with other modules in a multiple level arrangement. Each vertical module wall contains an embedded steel leg structure near the forward and rear quarter points of the module extending from top to bottom thereof. In the multiple tier mausoleum constructed from stacked modules, steel support and bearing legs extend continuously from top to bottom in the structure. Rectangular steel shims are intervened with the embedded legs of each module to render the entire leg structure continuous. The arrangement greatly minimizes settlement normally encountered with shim and grout supports and reduces the binding of shutters dependent on the system for support. The solid block shims can also resist shear stresses caused by lateral forces which grout cannot resist.

11 Claims, 6 Drawing Figures

MODULAR MAUSOLEUM

BACKGROUND OF THE INVENTION

In the field of modular cast concrete buildings and more particularly in connection with modular mausoleums which provide multiple above ground burial vaults or crypts, there is a need for simplified and economical means to provide strength and structural integrity in such structures in a way that will not detract from their convenience and comparative low cost of erection.

Some examples of the relevant patented prior art on reinforced concrete building structures are shown in U.S. Pat. Nos. 1,030,385; 3,238,732; 3,545,214; 3,562,978; 3,744,200 and 3,894,373.

The present invention is thought to satisfy the above-stated need of the art in a way not known in the prior art through the provision of a unique supporting leg structure for a multiple tier stacked module concrete mausoleum or like building. More particularly, according to the invention, each vertical wall of each multi-crypt module is provided with an embedded steel leg consisting of a pair of side-by-side rods having a top or cap plate welded thereto below the top face of the horizontal shelf portion of the module and within a rabbet of the shelf. Formed foot plates are similarly welded to the bottoms of the rods forming each leg and provide recessed seats for solid rectangular cross section steel shims which are intervened between the embedded legs of each module to provide a solid and continuous steel support leg extending throughout the full vertical height of the mausoleum structure. The described continuous legs are provided in pairs on the modules at or near their quarter points fore and aft.

Some advantages of the invention are:

1. Each leg shim fits into the shelf rabbet of the module directly below and into the recessed seat of the module foot plate directly above, thus rendering the modules very easy to stack in precise alignment when erecting a mausoleum.

2. The centers of the vertical steel embedded legs are always in axial alignment with the embedded legs therebelow in the structure.

3. The invention provides a steel-to-steel vertical column from top to bottom of the multiple tier mausoleum and the crypt modules are stacked to a close tolerance in overall height and from crypt-to-crypt, due to the uniformity of the steel legs.

4. After careful setting and leveling of the first tier on a suitable foundation, all other tiers can be quickly and easily stacked without the use of grout or other leveling techniques. The joints between tiers of crypts can be grouted or sealed at a later time by less skilled labor compared to other systems which must be grouted and leveled during erection.

5. Steel shims can be welded to the leg cap and foot plates after erection of the mausoleum for added stength and resistance to earthquakes and settlement.

6. The invention assures an even distribution of vertical stresses throughout the structure to prevent cracking.

DETAILED DESCRIPTION

Figure 1:
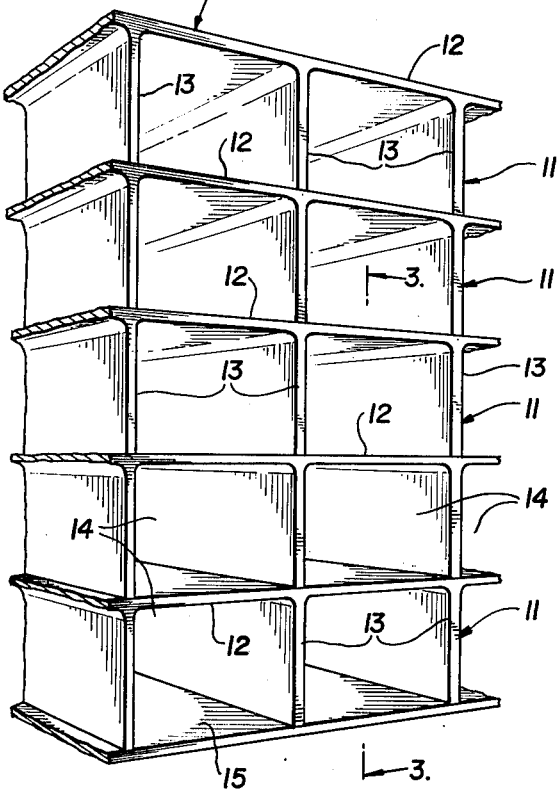
FIG. 1 is a fragmentary perspective view of a modular mausoleum embodying the invention.

Referring to the drawings in detail wherein like numerals designate like parts, a multiple tier concrete mausoleum 10 or similar building is constructed by vertically stacking prefabricated cast concrete modules 11 each having an upper horizontal shelf 12 and two or more vertical leg walls 13 depending therefrom. In practice, a preferred module 11 will provide three separated burial vaults or crypts 14 defined by one integral shelf 12 and four equidistantly spaced vertical leg walls 13. At a given level or tier of the total structure 10, side-by-side modules 11 may be joined within that tier in any acceptable manner known in the art. It will be seen that the burial crypts 14 in the structure 10 are equally sized and approximately rectangular in cross section and open fore and aft before being sealed by conventional techniques. Any suitable foundation means 15 for the mausoleum 10 may be utilized.

Figure 3:
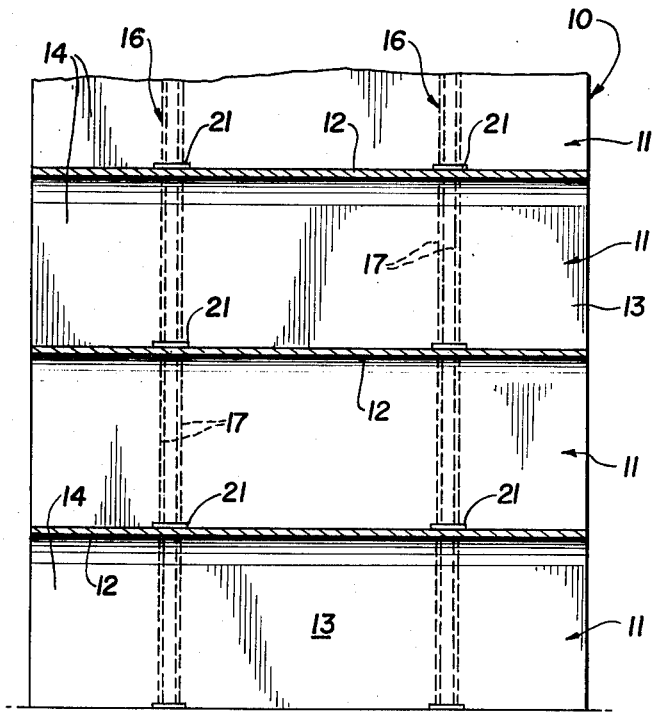
FIG. 3 is a fragmentary vertical section taken on line 3—3 of FIG. 1.

The invention proper is embodied in a unique steel-to-steel vertical leg structure which, in the erected mausoleum, extends from top to bottom thereof without interruption. As best shown in FIG. 3, a pair of leg structures 16 according to the invention is provided with one leg structure at the fore and aft quarter points of the multiple crypt mausoleum. This is the preferred arrangement for the best possible distribution of stresses.

Continuing to refer to the drawings, each continuous vertical steel-to-steel leg structure 16 is formed in the following manner. A pair of side-by-side parallel vertical steel rods 17 is embedded and cast within each leg wall 13 centrally thereof with the rods 17 extending nearly from top to bottom of each module 11. At their tops, each rod pair 17 is welded to a flat horizontal cap plate 18 which itself is molded into the module 11 immediately below and in communication with a shallow rabbet 19, or recess, in the top of shelf 12.

Figure 4:
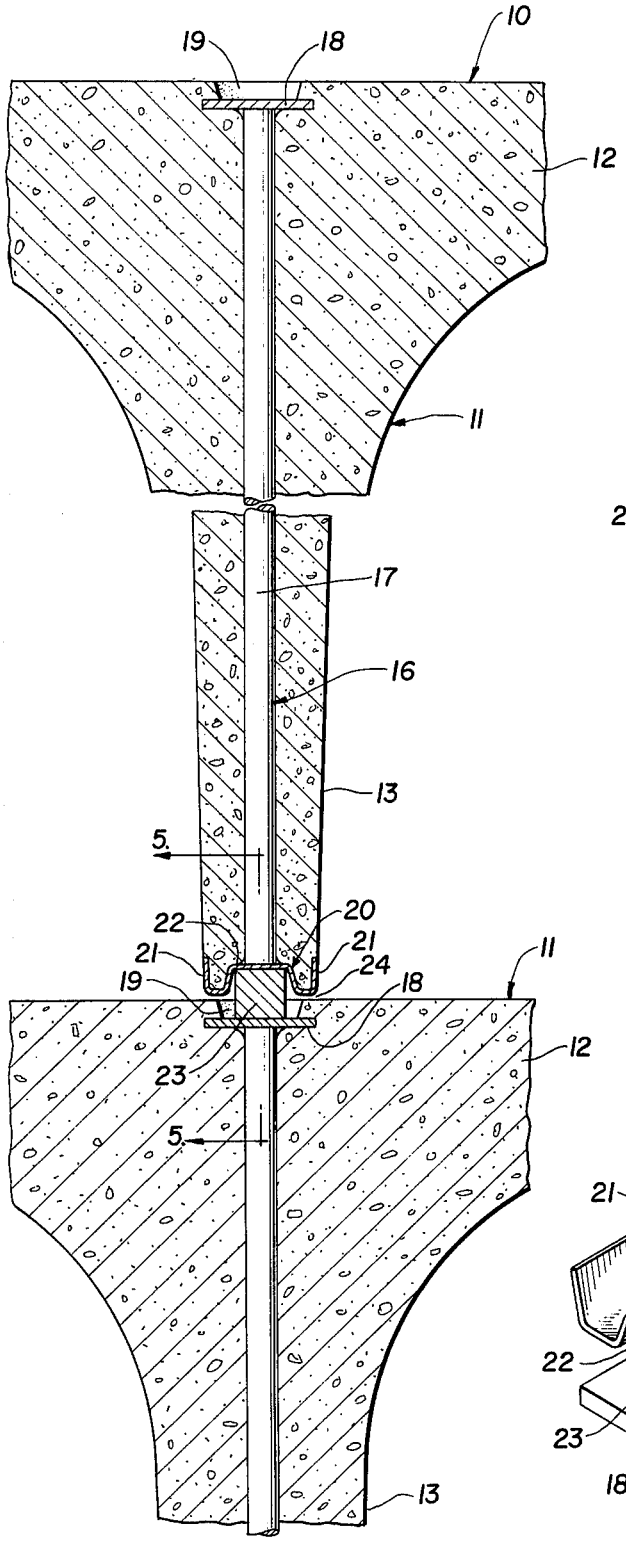
FIG. 4 is an enlarged fragmentary vertical section through the continuous steel-to-steel leg structure in accordance with the invention.
Figure 5:
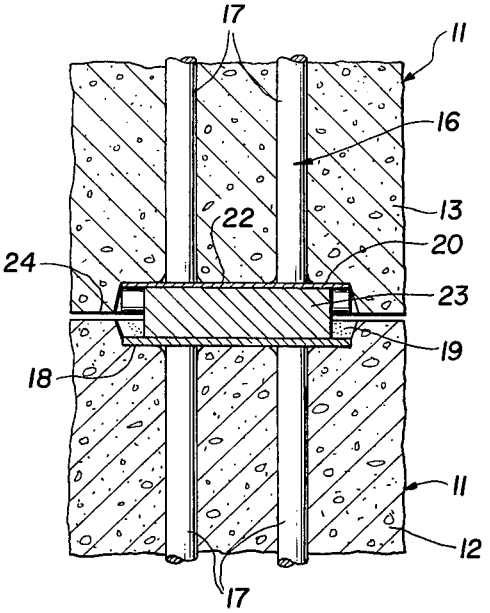
FIG. 5 is a fragmentary vertical section taken on line 5—5 of FIG. 4.
Figure 6:
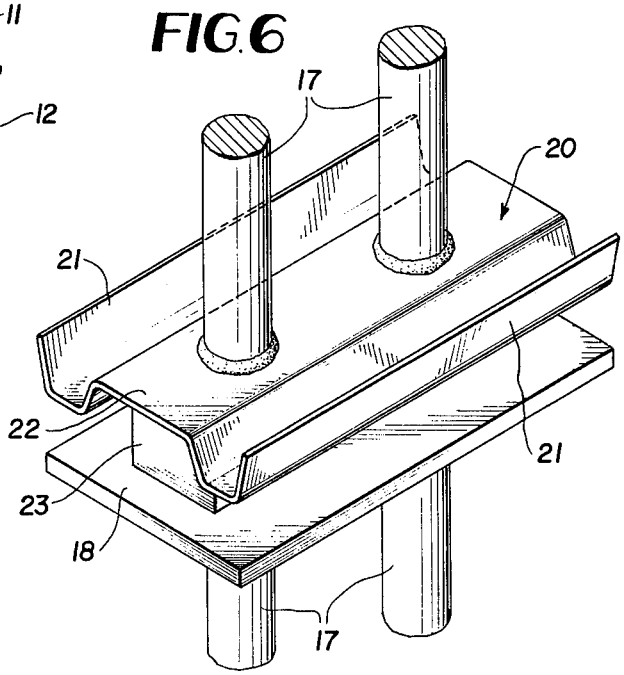
FIG. 6 is an enlarged fragmentary perspective view of a shim and cooperating foot and cap plates employed in the leg structure.

Similarly, the lower ends of each rod pair 17 are welded to a formed steel foot plate 20 having side flanges 21 lapping the lower edges of the leg wall 13 and a center channel portion 22 forming a stable seat for a preferably square cross section solid steel shim 23, or bearing block, which is placed between each opposing cap and foot plate 18 and 20 of adjacently stacked modules 11. As shown in FIGS. 5 and 6, the plates 18 and 20 and the shim 23 are elongated across the parallel vertical rods 17 for increased strength and stability in the vertical leg structure. A continuous vertical steel-to-steel load bearing leg is thus formed from top to bottom of the modular mausoleum formed of the stacked modules 11. One such continuous leg 16 is located at each fore and aft quarter point of the structure, as stated. Each vertical wall 13 has a section of the steel leg cast therein and extending vertically therethrough, as described. The rabbet 19 at the top of each module is open to receive the shim 23 with adequate clearance, FIG. 4, and the downwardly open seat 22 likewise receives the shim. The small gaps 24, FIG. 4, remaining between the lower edges of the walls 13 and the tops of horizontal shelves 12 are sealed or grouted after the mausoleum 10 is erected by simple stacking of the modules 11 one upon another to form the several tiers or levels of the multi-crypt structure.

Figure 2:
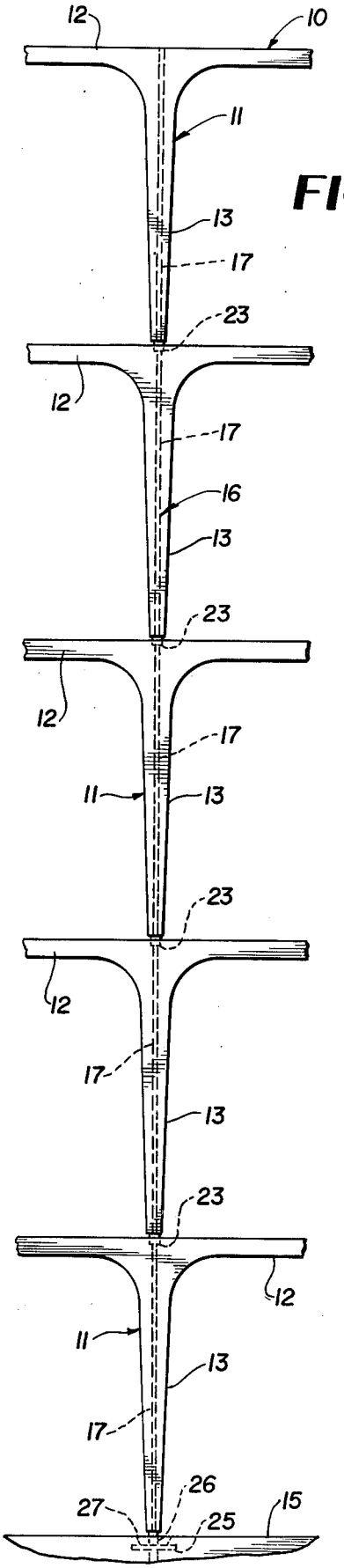
FIG. 2 is a fragmentary front elevational view of a modular mausoleum with continuous reinforcing leg structure according to the invention.

Referring to FIG. 2, while any sort of foundation for the mausoleum may be utilized, if desired, a steel foundation plate 25 may be embedded slightly below the top surface of foundation slab 15 and a shim block 26, similar to the shim 23, may be employed within a foundation rabbet 27. The plate 25 can be suitably supported as necessary from below or within the foundation slab 15 depending upon the weight of the modular structure.

While the crypts are illustrated and described as being open fore and aft, they may be made open at one end or the other as the need dictates in certain cases, and the invention is not limited in this respect.

The described top-to-bottom steel-on-steel leg structure for the crypt bank prevents differential settling of crypts and avoids misalignment and jamming of granite front panels, as frequently occurs under conventional methods of construction.

The main advantages of the structure having already been enumerated, it is thought that the described features will be readily understood by those skilled in the art particularly in terms of the uninterrupted steel-to-steel vertical legs 16 extending from top to bottom of the stacked modular multi-crypt mausoleum with steel shims intervened between the embedded rods in the vertical walls of the several modules.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a modular multi-level concrete structure formed from vertically stacked cast concrete modules, each module having a vertical load bearing wall in alignment with like walls of other modules in said structure, the improvement comprising a continuous top to bottom load bearing leg structure within said aligned vertical walls of the multi-level structure, said leg structure comprising at least one vertical rod embedded in the vertical wall of each module and extending substantially from the top to the bottom thereof, and a load bearing shim interposed between the opposing ends of the rods in adjacent modules to form therewith said continuous leg structure from top to bottom of said multi-level structure.

2. In a modular structure as defined in claim 1, said leg structure comprising a pair of side-by-side spaced vertical rods in the vertical wall of each module, a horizontal cap plate joining the tops of said rods in each module near and below the top face of each module, said top face being rabbetted adjacent to said cap plate to expose the cap plate, and a foot plate joining the bottoms of said rods in each module near and above the bottom face of said vertical wall and having a recessed portion forming a seat for said shim with the shim disposed between the foot plate and the opposing cap plate of the next lowermost module.

3. In a modular structure as defined by claim 2, and wherein said shim comprises a rectangular cross section bar-like shim extending across said side-by-side spaced vertical rods, said cap plate and foot plate being elongated in the direction of said shim and across said rods and somewhat beyond the outward sides of said rods.

4. In a modular structure as defined by claim 3, and said cap plate being a flat plate, and said foot plate having a channel-like center portion forming said seat and a pair of side flanges spaced laterally of the channel portion and lapping the bottom edges of said vertical wall.

5. In a modular structure as defined by claim 1, wherein each module in said multi-level structure comprises a horizontal shelf and plural laterally spaced vertical load bearing walls defining front-to-back horizontal crypts in said structure, and a pair of said continuous top to bottom load bearing leg structures within said aligned vertical walls substantially at the fore and aft quarter points of the modules.

6. In a modular structure as defined by claim 2, and said cap and foot plates joined to said vertical rods by welding to thereby form a unitized load bearing leg section embedded in each module.

7. In a modular structure as defined by claim 6, and said shim being a rectangular cross section block-like element having flat and parallel top and bottom faces, said cap and foot plates having coacting flat horizontal faces directly abutting the top and bottom faces of the shim.

8. In a modular structure as defined by claim 7, and the shim having a vertical thickness whereby a slight gap is provided between the top face of each module and the bottom face of the module immediately thereabove in said multi-level structure, said gap adapted to be sealed after the erection of the multi-level structure.

9. In a modular structure as defined by claim 1, and said shim having a vertical thickness sufficient to create slight gaps between the tops and bottoms of adjacent modules in said structure, said gaps adapted for sealing or grouting after the erection of said structure.

10. In a modular structure as defined by claim 9, and said vertical rod and shim formed of steel.

11. In a modular structure as defined by claim 9, and a channel-like foot plate fixedly secured to the lower end of each vertical rod and having an open side facing downwardly, a cap plate fixedly secured to the upper end of each rod in opposing relation to said downwardly facing open side of the foot plate, said cap plate disposed at the bottom of a rabbet in the top of each module, said shim comprising a block-like element of precise size positioned between said foot plate and cap plate and entering the downwardly opening channel recess of the foot plate and said rabbet, whereby grout may be introduced around said shim to fill the rabbet and the downwardly open recess of the foot plate.

* * * * *